US008262467B2

(12) United States Patent
Jaffe

(10) Patent No.: US 8,262,467 B2
(45) Date of Patent: Sep. 11, 2012

(54) WAGERING GAME SYSTEM FOR PROVIDING GAMING ESTABLISHMENT WITH GUARANTEED THEORETICAL WINNING PERCENTAGE

(75) Inventor: Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 243 days.

(21) Appl. No.: 12/680,828

(22) PCT Filed: Oct. 1, 2008

(86) PCT No.: PCT/US2008/078464

§ 371 (c)(1),
(2), (4) Date: Mar. 30, 2010

(87) PCT Pub. No.: WO2009/046117

PCT Pub. Date: Apr. 9, 2009

(65) Prior Publication Data

US 2011/0269525 A1 Nov. 3, 2011

Related U.S. Application Data

(60) Provisional application No. 60/997,223, filed on Oct. 2, 2007.

(51) Int. Cl.
*A63F 9/24* (2006.01)

(52) U.S. Cl. ..... 463/25

(58) Field of Classification Search ..... 436/25
See application file for complete search history.

(56) References Cited

U.S. PATENT DOCUMENTS

| | | | | |
|---|---|---|---|---|
| 5,967,896 | A | 10/1999 | Jorasch et al. | |
| 6,375,568 | B1 | 4/2002 | Roffman et al. | |
| 2001/0055990 | A1 | 12/2001 | Acres | |
| 2004/0133485 | A1 * | 7/2004 | Schoonmaker et al. | 705/30 |
| 2006/0287040 | A1 * | 12/2006 | Walker et al. | 463/16 |
| 2007/0004494 | A1 | 1/2007 | Taylor | |
| 2007/0060252 | A1 | 3/2007 | Taylor | |
| 2007/0082725 | A1 | 4/2007 | Low et al. | |
| 2007/0259709 | A1 * | 11/2007 | Kelly et al. | 463/20 |

FOREIGN PATENT DOCUMENTS

| | | | |
|---|---|---|---|
| JP | 2007-029145 | A | 2/2007 |
| JP | 2007-054157 | A | 3/2007 |

OTHER PUBLICATIONS

"Slot machine tips", homepokergames.com, as captured by archive.org on Apr. 20, 2007.*

(Continued)

*Primary Examiner* — Corbett B Coburn
(74) *Attorney, Agent, or Firm* — Nixon Peabody LLP

(57) ABSTRACT

A gaming system maintains a theoretical payback for a gaming establishment and comprises a plurality of gaming machines, a network, and a controller. The plurality of gaming machines are for playing wagering games having a plurality of symbols that indicate a randomly selected outcome of the wagering games. Each of the gaming machines has a theoretical payback that is associated with a math algorithm for generating the randomly selected outcomes. Each of the gaming machines has an actual payback of awards that are provided to players. The network is connected to the plurality of gaming machines. The controller is within the network and is operative to send instructions for transferring funds from a first account to a second account. The funds are based on a summation of differentials between the actual payback and the theoretical payback that occurred over a certain period of time at the gaming machines.

25 Claims, 5 Drawing Sheets

OTHER PUBLICATIONS

PCT International Search Report for International Application No. PCT/US2008/078464 dated Dec. 2, 2008 (2 pages).

PCT Written Opinion for International Application No. PCT/US2008/078464 dated Dec. 2, 2008 (6 pages).

* cited by examiner

WAGERING GAME SYSTEM FOR PROVIDING GAMING ESTABLISHMENT WITH GUARANTEED THEORETICAL WINNING PERCENTAGE

PRIORITY CLAIM AND CROSS REFERENCE TO RELATED APPLICATIONS

This application is a U.S. national stage of International Application No. PCT/US2008/078464, filed Oct. 1, 2008, which is related to and claims priority to U.S. Provisional Application No. 60/997,223, filed Oct. 2, 2007, each of which is incorporated herein its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games and, in particular, to a gaming system in which the gaming establishment is provided with a relatively constant cash flow despite the inherent volatility of payouts by gaming machines within the gaming establishment.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system comprises a controller and a plurality of gaming machines for playing one or more wagering games having a plurality of symbols that indicate randomly selected outcomes of the wagering games. Each of the gaming machines has a theoretical payback that is associated with a math algorithm for generating the randomly selected outcomes. Each of the gaming machines also has an actual payback that is different from the theoretical payback by a differential. The controller is coupled to the plurality of gaming machines and operative to determine a summation of the differentials for the plurality of gaming machines for a certain period of time. The controller may also instruct the transfer of funds from one account to another account based on the summation of the differentials.

According to another aspect of the invention, a method of maintaining a theoretical payback for wagering games played within a gaming establishment comprises receiving wagers from players for playing the wagering games at the gaming establishment, and providing awards to players of the wagering games. The awards are an actual payback to the players and are different from the theoretical payback. The method further includes determining a differential between the theoretical payback and the actual payback for a certain period of time, and if the theoretical payback is less than the actual payback, transferring funds from a first account to a second account associated with the gaming establishment. The funds transferred to the second account correspond to the differential.

According to yet another aspect of the invention, a method of maintaining a theoretical payback for a gaming establishment operating a plurality of gaming machines comprises collecting wager-input data for the plurality of gaming machines that corresponds to wager inputs made by players at the plurality of gaming machines. The method further includes determining an actual payback made from the plurality of gaming machines as awards to the players, and comparing the actual payback to a theoretical payback for the plurality of gaming machines for a certain period of time. Further, the method includes, in response to the theoretical payback being less than the actual payback, providing the gaming establishment with monetary funds corresponding to a differential between the actual payback and the theoretical payback.

According to yet another aspect, a gaming system maintains a theoretical payback for a gaming establishment and comprises a plurality of gaming machines, a network, and a controller. The plurality of gaming machines are for playing one or more wagering games having a plurality of symbols that indicate a randomly selected outcome of the wagering games. Each of the gaming machines has a theoretical payback that is associated with a math algorithm for generating the randomly selected outcomes. Each of the gaming machines has an actual payback of awards that are provided to players of the wagering games. The network is connected to the plurality of gaming machines. The controller is within the network and is operative to send instructions for transferring funds from a first account to a second account. The funds are based on a summation of differentials between the actual payback and the theoretical payback that occurred over a certain period of time at each of the plurality of gaming machines.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
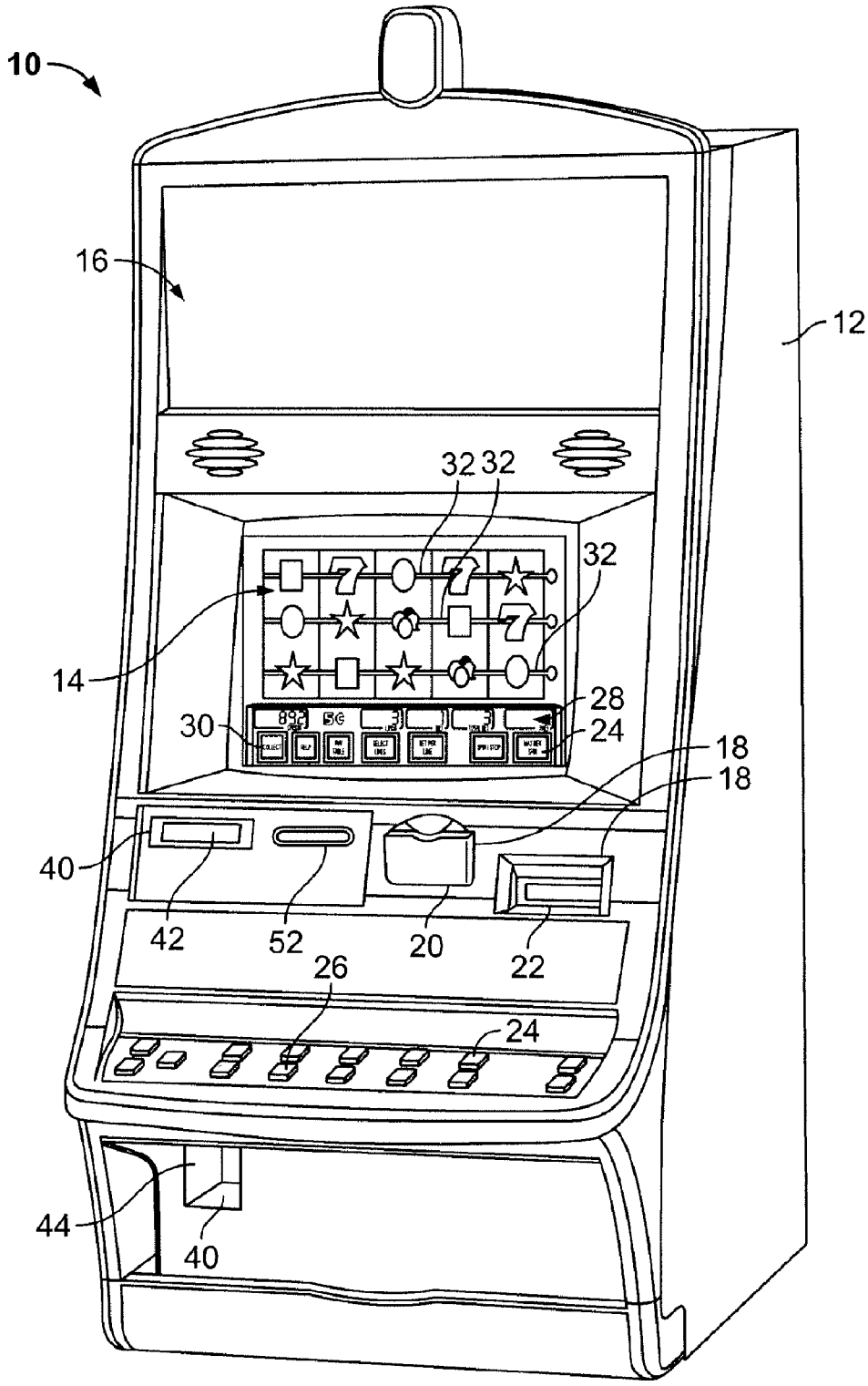
FIG. 1*a* is a perspective view of a free standing gaming machine.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the base wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the base wagering game is displayed to the player on the primary display 14. The primary display 14 can also display the bonus game associated with the base wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the base wagering game by making a wager via the value input device 18 of the gaming machine 10. A player can select play by using the player input device 24, via the buttons 26 or the touch screen keys 30. The base game consists of a plurality of symbols arranged in an array, and includes at least one payline 32 that indicates one or more outcomes of the base game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information.

Also, in some embodiments, the information reader 52 may be used to restore game assets that the player achieved and saved during a previous game session. Assets may be any number of things, including, but not limited to, monetary or non-monetary awards, features that a player builds up in a base, bonus or progressive game to win awards, etc. Monetary awards can include game credits or money. Non-monetary awards, or wagering-game enhancement parameters, can be free plays (e.g., free spins), extended game play, multipliers, wild reels, multiplying wilds, access to bonus and/or progressive games, or any such wagering-game enhancement parameters that allow players to receive additional or bonus awards.

Figure 1B:
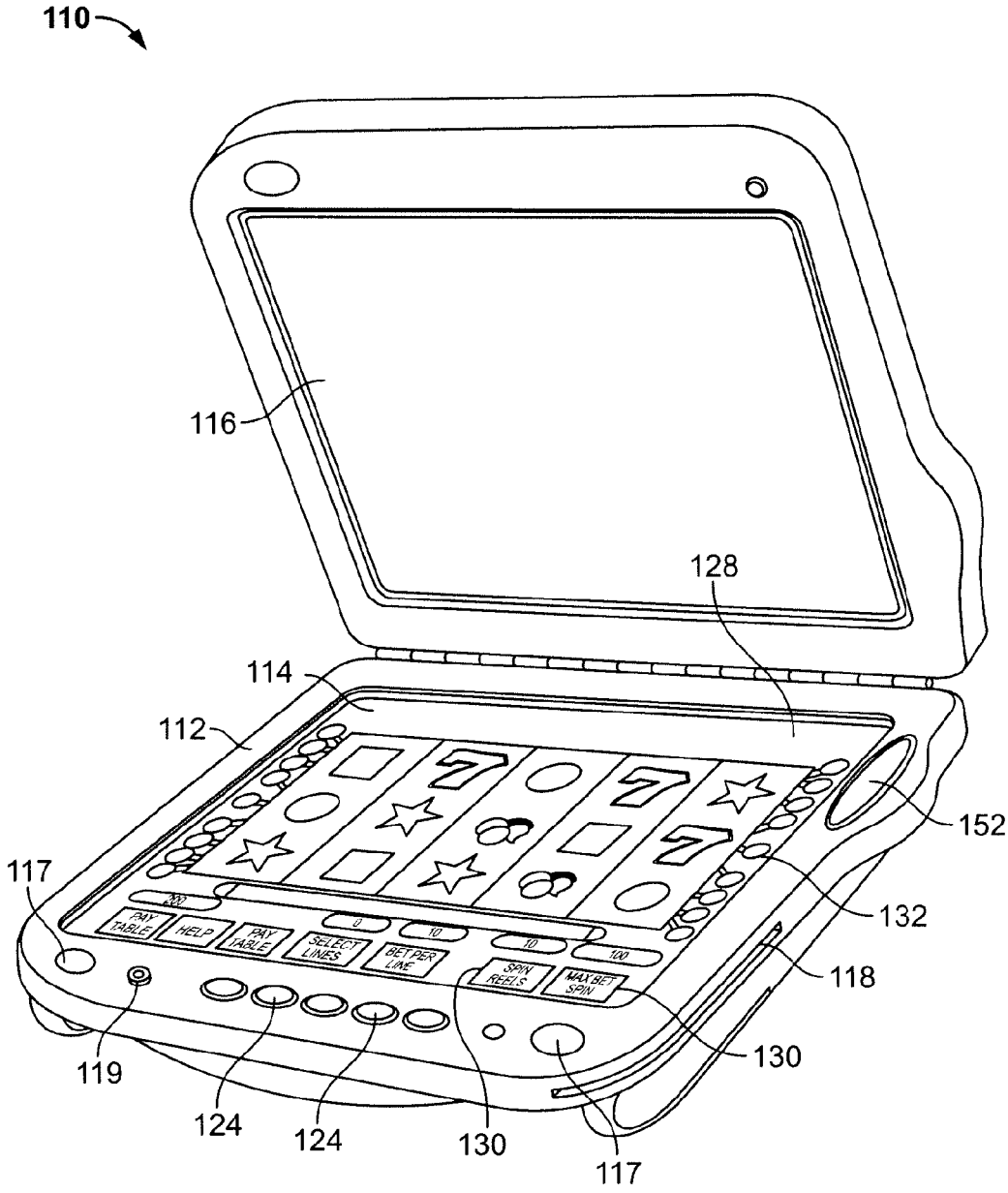
FIG. 1*b* is a perspective view of a handheld gaming machine.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the base wagering game on the handheld gaming machine 110 is displayed to the player on the primary display 114. The primary display 114 can also display the bonus game associated with the base wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the base wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the base game may comprise a plurality of symbols arranged in an array, and includes at least one payline 132 that indicates one or more outcomes of the base game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
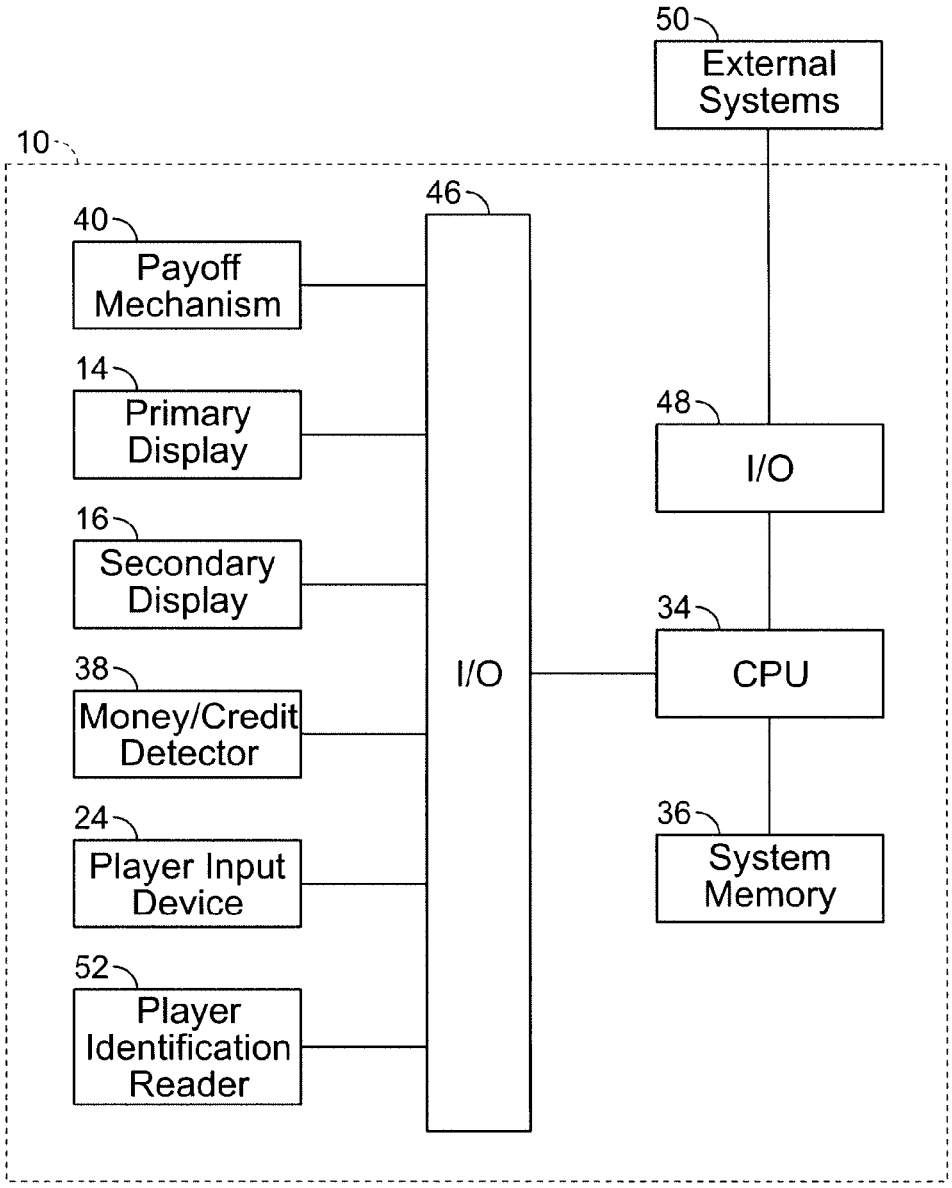
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the base game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

In the various wagering games that can be played on the gaming machine 10, the gaming machines 10 have a theoretical payback percentage, which is a function of the underlying math algorithms that are used for randomly selecting the outcome of the game. As an example, a gaming machine 10 may have a theoretical payback percentage of 90% such that, over an extended period of time (e.g., months or years), the wagering game would payout 90% of all wagers as payout awards to players. However, because each gaming machine 10 has an inherent volatility associated with the random selection of the outcomes, the actual payback percentage over a short period of time (e.g., days) will be less than or greater than 90%. Consequently, there are days when the gaming establishment "makes" money on a particular gaming machine 10, and days when the gaming establishment "loses" money on that same game machine 10. The applicants have discovered that what is needed is a gaming system that removes the inherent volatility of the gaming machines so as to provide the gaming establishment with a relatively constant stream of income derived by the gaming machines 10.

Figure 3:
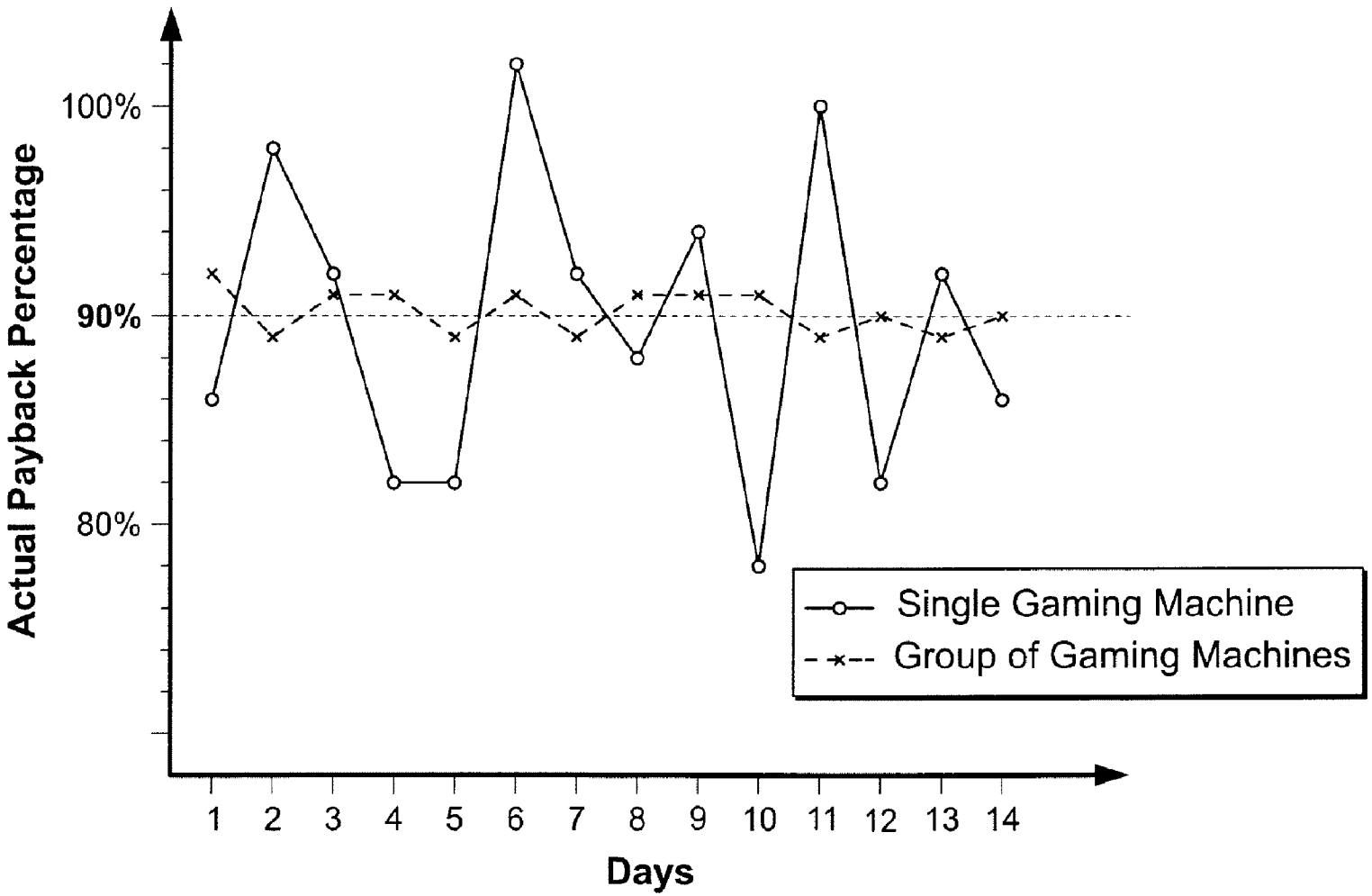
FIG. 3 is a graph that illustrates the inherent volatility of a single gaming machine and a group of gaming machines.

FIG. 3 is a graphical illustration of what can be expected for actual payback percentages from a single gaming machine 10 and a group of gaming machines 10 that have a theoretical payback percentage of 90%. Generally, gaming machines have a fixed theoretical payback percentage that is in the range from about 80% to about 95%, and the 90% value has been chosen for this example. According to FIG. 3, for each $1.00 that is wagered by players to play the gaming machine(s) 10, the players should receive 90 cents in actual paybacks when considered over a substantial period of time (e.g., months or years). These actual paybacks are in the form of monetary awards, such as in credits or the like. In the graph of FIG. 3, the x-axis is measured in "Days" such that each data point represents the actual payback for a one-day period.

As can be seen in FIG. 3, when considering a single gaming machine 10, there is an inherent volatility of the wagering game over a short period of time, such as a day or a week. On some days, the gaming machine 10 may provide an actual payback that is greater than the amount of wagers that were received, such that the actual payback percentage exceeds 100%. This inherent volatility is due to the underlying math algorithms that are used to determine the randomly selected outcomes of the wagering games at the gaming machine 10. This random number selection may be performed by the controller 34 within the gaming machine 10. Or, the random number selection may be performed by a controller located within a network or server that is coupled to the gaming machine 10. In any event, the randomness of the selection will not yield the 90% theoretical payback percentage in the short-term but, over time, the cumulative value of the awards to players will cause the actual payback percentage to approach the 90% theoretical payback percentage.

When considering a group of gaming machines 10 that each has a theoretical payback percentage of 90%, the volatility of the actual payback for the gaming machines as a group decreases because the "highs" and "lows" of certain gaming machines 10 within the group tend to average out. As with the single gaming machine 10, the randomness of the selections at the group of gaming machines 10 will not yield the 90% theoretical payback percentage in the short-term but, over time, the cumulative value of the awards to players will cause the actual payback percentage to approach the 90% theoretical payback percentage.

FIG. 3 can also be considered from the standpoint of the revenue that is generated by the gaming establishment from the gaming machines 10. The gaming establishment would typically make an assumption that its cash flow will be 10% of each dollar that is wagered on each gaming machine having a 90% theoretical payback. However, the actual cash flow fluctuates around the 10% level on any given day for a single gaming machine 10. Even when considering the smaller fluctuation experienced by a group of gaming machines 10 (as opposed to single machine 10), the differential between the actual cash flow and the theoretical cash flow can still be quite large because of the larger turnover in a group of machine ("Turnover" refers to the wagers placed in a gaming machine). As an example, if the group of gaming machines 10 in the graph of FIG. 3 is twenty gaming machines having a combined turnover of $30,000 in a single day, and the actual payback percentage is at 91% for a day (as opposed to the theoretical payback percentage of 90%), then the cash flow for the gaming establishment would be "short" by a $300 (i.e., 1% of $30,000) for those twenty gaming machines on that day. In another example, a gaming establishment may have a "high-limit" area in which players can place much larger wagers (e.g., a 100-coin, $1.00 denomination gaming machine 10) that could yield actual payouts in the range of $10,000 to $100,000. These "high limit" areas result in a turnover on each gaming machine 10 that is much higher on a daily basis, creating significant volatility.

While many gaming establishments may be able to absorb such a financial shortfall on a given day, smaller gaming establishments may have a difficult time in doing so. Further, even larger gaming establishments still desire a continuous and predictable flow of case. As such, these are just a few of several scenarios for larger and smaller gaming establishments in which the present invention helps to alleviate cash flow problems due to the inherent volatility in the gaming machines, as described below.

Figure 4:
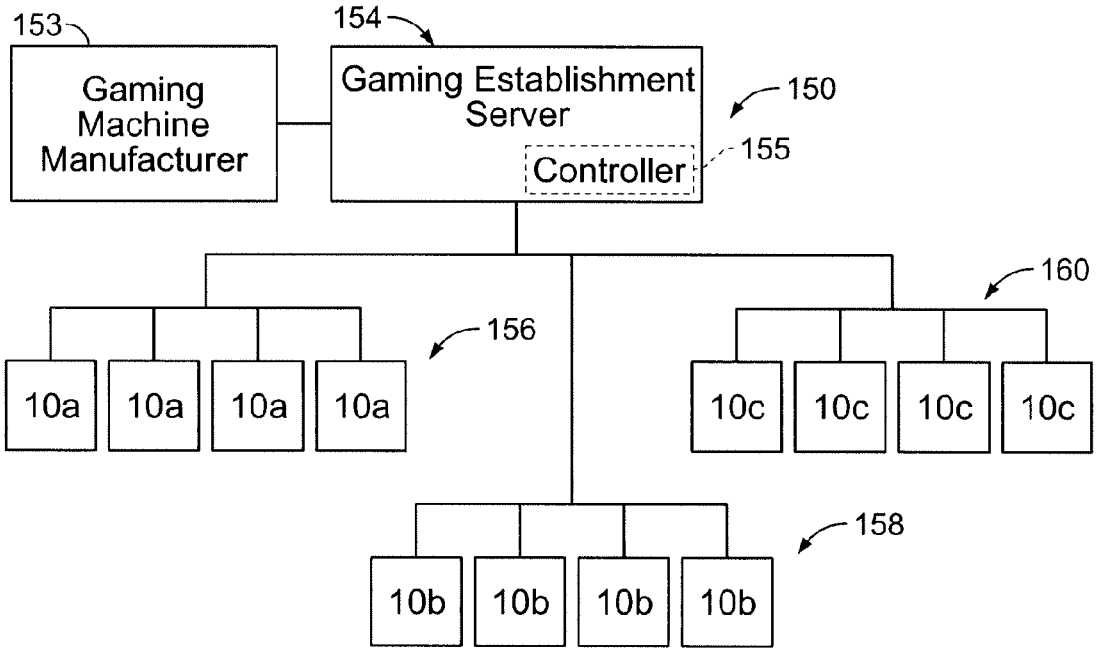
FIG. 4 is a schematic illustrating a network in which a gaming establishment is in communication with a gaming machine manufacturer.

FIG. 4 illustrates a schematic of a network 150 having a plurality of gaming machines 10. In this illustrated example, the gaming machine manufacturer 153 is connected to the network 150 through a gaming establishment server 154. The gaming establishment server 154 includes a controller 155, which is used for functions related to the determination of the actual payback of the gaming machines 10 and/or the transfer of funds between the gaming establishment and the gaming machine manufacturer 153, as will be described in further detail below.

The network 150 includes a first bank 156 of gaming machines 10*a*, a second bank 158 of gaming machines 10*b*, and a third bank 158 of gaming machines 10*c*. The gaming machines 10*a* in the first bank 156 may be different from the gaming machines 10*b* in the second bank 158 and the gaming machines 10*c* in the third bank 160. Likewise, the theoretical payback percentage for the gaming machines 10*a* in the first bank 156 may be 88%, while the theoretical payback percentage for the gaming machines 10*b* in the first bank 156 and the gaming machines 10*c* in the second bank 160 may be 91% and 92%, respectively. Accordingly, the gaming establishment server 154 is coupled to different gaming machines 10 with different theoretical payback percentages within the gaming establishment.

In one embodiment, the internal controller 34 (FIG. 2) in each of the gaming machines 10*a*, 10*b*, and 10*c* collects the wagering input data and determines the actual payback for that specific machine for a one-day period. The controller 34 within each gaming machine 10 would then determine the differential between the actual payback and the theoretical payback for that gaming machine 10. The server 154 then receives this differential data from each gaming machines 10*a*, 10*b*, and 10*c*. Each gaming machine 10*a*, 10*b*, and 10*c* may be programmed to transmit the required information to the server 154 at a certain time. Or, the server 154 may poll each gaming machine 10*a*, 10*b*, and 10*c* for the required information. Because the gaming machine 10 is conducting the calculations in accordance with the software program provided by its gaming machine manufacturer, the gaming machine manufacturer has a high level of confidence that the calculation is done correctly, which is important as funds may be transferred from the gaming machine manufacturer's account based on this calculation, as noted below.

Alternatively, the server 154 may use its own controller 155 to determine the differential between the actual payback and the theoretical payback for each gaming machine 10*a*, 10*b*, and 10*c* based on wagering input data and actual payback data provided by each gaming machine 10*a*, 10*b*, and 10*c*. In this situation, the server 154 may poll each gaming machine 10*a*, 10*b*, and 10*c* for that data, or each gaming machine 10*a*, 10*b*, and 10*c* may simply transmit the required information to the server 154 at a certain time.

Regardless of the manner in which the server 154 obtains the necessary information, the server 154 calculates the total differential between the actual payback and the theoretical payback for all of the gaming machines 10*a*, 10*b*, and 10*c*. The server 154 is in communication with the gaming machine manufacturer 153 to the provide the total differential to the gaming machine manufacturer 153. An intermediate communication device may be located between the server 154 and the gaming machine manufacturer 153 to facilitate this communication function.

To maintain the cash flow associated with the gaming machines 10*a*, 10*b*, and 10*c* at a known level as dictated by their associated theoretical payback percentages, the gaming machine manufacturer 153 transfers funds from its account to the gaming establishment's account so as to offset the differential if the gaming machines 10*a*, 10*b*, and 10*c* have "underheld" (i.e., when the gaming machines have provided awards to cause the actual payback percentage to exceed 90%). On the other hand, the gaming establishment transfers funds from its account to the account of the gaming machine manufacturer 153 so as to offset the differential if the gaming machines 10*a*, 10*b*, and 10*c* have "overheld" (i.e., when the gaming machines have provided lesser awards to cause the actual payback percentage to be less than 90%). In short, the gaming machine manufacturer 153 assists in removing the volatility from the operation of the inherently volatile gaming machines 10*a*, 10*b*, and 10*c*.

It should be noted that the server 154 can be a dedicated accounting server that is used by the gaming establishment to obtain, analyze, and/or record financial data for the gaming machines 10*a*, 10*b*, and 10*c* throughout the gaming establishment. Alternatively, the server 154 can be a wagering game server that serves the purpose of providing wagering game content (e.g., updates to games, new games, random number generation, etc) to the gaming machines 10*a*, 10*b*, and 10*c*.

Figure 5:
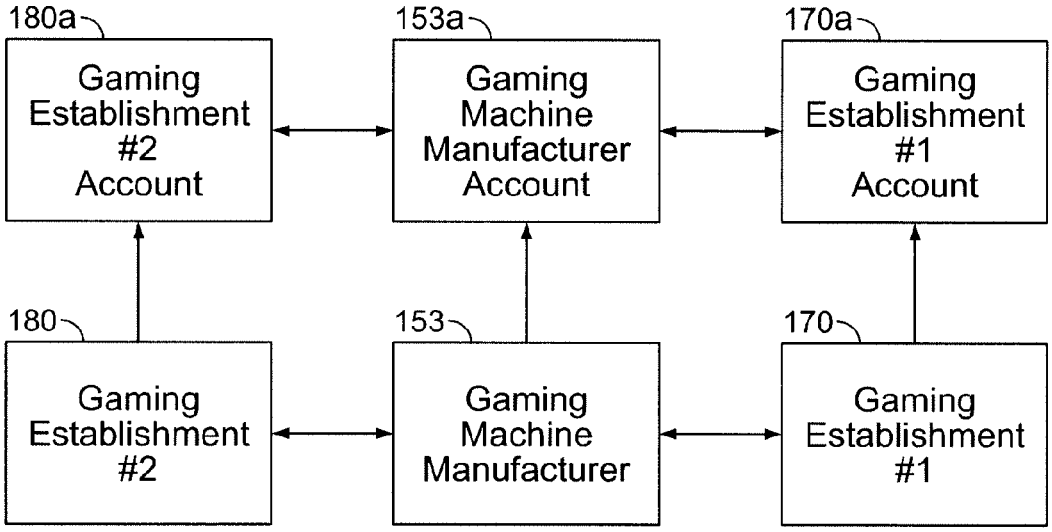
FIG. 5 is a schematic illustrating a network linking the accounts of a gaming machine manufacturer and a plurality of gaming establishments.

FIG. 5 illustrates one type of network architecture used by the gaming machine manufacturer 153 for transferring funds to and from its account 153*a* in response to receiving information from a first gaming establishment 170 and a second gaming establishment 180. The gaming establishments 170 and 180 are connected to the gaming machine manufacturer 153 for periodically transmitting the information on the total differential between the actual payback and the theoretical payback for their respective gaming machines. Based on this information, the funds are transferred between the gaming machine manufacturer account 153*a* and the first gaming establishment account 170*a*, and between the gaming machine manufacturer account 153*a* and the second gaming establishment account 180*a*. The fund transfers can occur automatically between the accounts in response to the total payback differential being finalized, such that the gaming establishments 170 and 180 and the gaming machine manufacturer 153 are simply provided notices once the transfers have occurred. Alternatively, the fund transfer can occur between the accounts only after approval is provided by the gaming establishments 170 and 180 and the gaming machine manufacturer 153.

If the gaming machine manufacturer 153 is providing this function of guaranteeing a theoretical payback for hundreds or thousands of gaming machines in several gaming establishments 170 and 180, the movement of funds in and out of the gaming machine manufacturer account 153*a* on a daily basis is such that the value of the account 153*a* is relatively constant because the cumulative volatility of many gaming machines tends to cancel the "highs" and "lows." In other words, the gaming machine manufacturer 153 does not "feel" the volatility of any one machine. Consequently, the gaming machine manufacturer account 153*a* can also be considered a community fund that several gaming establishments 170 and 180 utilize on a daily basis to guarantee the theoretical payback of the gaming machines within the gaming establishments 170 and 180.

In the examples set forth, the period of time for calculating the differential between the actual payback and the theoretical payback and the transfer of funds has been assumed to be one day. However, the time period can be varied, such as a 24-hour period overlapping two days. Or, the time period can be several days, or a week. The timing of the transfer of funds can also be varied. For example, the gaming machine manufacturer 153 may transfer money from its account on a daily basis, but only receive transferred funds from a gaming establishment on a weekly basis (i.e., the weekly transfer would be the summation of the total differential on the days when the gaming machines have "overheld" and paid less than the theoretical payback). In this arrangement, the gaming machine manufacturer 153 is essentially providing a short term loan (i.e., weekly) to the gaming establishment, which may be subject to a fee charged by the gaming machine manufacturer 153.

Further, while the invention has been described relative to the gaming machine manufacturer 153, any entity could provide this inventive function of guaranteeing a theoretical payback to the gaming establishments. For example, an entity that leases gaming machines (oftentimes the gaming machine manufacturer) or a distributor of gaming machines may provide this function.

Regardless of what entity provides the function of guaranteeing a theoretical payback, the entity may charge a fee for the service. For example, the fee could be a flat fee on a monthly basis. In another option, a flat fee may be applied to all transfers, or just to fund transfers that are made to the gaming establishment. Alternatively, a fee equivalent to a certain percentage of the amount of the transfer may be applied. The fee(s) may be directly deducted from the funds to be transferred such that the amount of the fund transfer is not equivalent to the gaming establishment's differential between the actual payback and the theoretical payback, but the fund transfer would still correspond to some percentage of that differential.

It should be noted that the gaming machines may provide multiple opportunities for a player to win awards. For example, the basic wagering game may not yield a winning outcome, but may trigger a bonus game in which the player may have the opportunity to win an award. Further, the wagering game may provide the opportunity for a player to participate in a larger-scale community game or progressive game. In any of these situations, the underlying math models that provide the random number generation will still dictate a known theoretical payback percentage for each wager, which allows the differential between the actual payback and the theoretical payback to be calculated.

Each of these embodiments and obvious variations thereof is contemplated as falling within the spirit and scope of the claimed invention, which is set forth in the following claims.

What is claimed is:

1. A gaming system configured to monitor wagering game performance, the gaming system comprising:

a plurality of gaming machines, each gaming machine of the plurality being operable to conduct one or more wagering games in which a plurality of symbols indicate randomly selected outcomes of the one or more wagering games, each gaming machine of the plurality having a theoretical payback that is based on a math algorithm for generating the randomly selected outcomes and an actual payback that is based on the randomly generated outcomes generated by each gaming machine in response to wagers, the actual payback of each gaming machine being different from the theoretical payback of the same gaming machine by a differential;

one or more processors;

a communications interface coupled to the plurality of gaming machines; and at least one memory device storing instructions that, when executed by the one or more processors, cause the one or more processors to operate with the plurality of gaming machines via the communications interface to determine a summation of the differentials for the plurality of gaming machines for a certain period of time.

2. The system of claim 1, wherein the wagering games played on at least one of the plurality of gaming machines are different from the wagering games played on another gaming machine of the plurality of wagering games.

3. The system of claim 2, wherein the theoretical payback of the at least one of the plurality of gaming machines is different from the theoretical payback of another gaming machine of the plurality of wagering games.

4. The system of claim 1, wherein the one or more processors and the at least one memory device are located within an accounting server in a gaming establishment.

5. The system of claim 1, wherein the one or more processors and the at least one memory device are located within a gaming server in a gaming establishment that provides gaming content to the plurality of gaming machines.

6. The system of claim 1, wherein the one or more processors execute a transfer of funds from a first account to a second account, the funds corresponding to the summation of the differentials.

7. The system of claim 6, wherein the funds are equivalent to the summation of the differentials.

8. The system of claim 1, wherein the certain period of time is one day.

9. The system of claim 1, wherein the theoretical payback for each gaming machine is equal to percentage of wagers placed at the gaming machine, the percentage being between 80 percent and 95 percent.

10. A computer-implemented method of monitoring wagering game performance on one or more gaming machines in a gaming establishment according to a theoretical payback for the wagering games played within the gaming establishment, the theoretical payback based on a math algorithm for generating randomly selected outcomes in the wagering games, the method comprising:

receiving, via at least one input device, wagers from players for playing the wagering games at the gaming establishment;

providing, via one or more first processors, actual paybacks to players of the wagering games based on the randomly selected outcomes of the wagering games;

determining, via one or more second processors, an individual differential comprising a difference between the theoretical payback and the actual payback of each of the one or more gaming machines for a certain period of time; and in response to the summation being greater than zero, transferring, via at least a first or second processor, funds corresponding to a summation of the individual differentials from a first non-player account to a second account associated with the gaming establishment.

11. The method of claim 10, further including, in response to the summation being less than zero, transferring the funds from the second account to the first account.

12. The method of claim 11, wherein the certain period of time is one day, and the transferring occurs on a daily basis.

13. The method of claim 10, wherein the one or more first processors are located in an accounting server on a communications network and the one or more second processors are located within the one or more gaming machines.

14. The method of claim 10, wherein the one or more first processors and the one or more second processors are the same processors.

15. The method of claim 10, wherein each of the one or more gaming machines individually determines the differential for the wagering games played thereon.

16. The method of claim 10, wherein the summation is determined by an accounting server coupled to the plurality of gaming machines.

17. The method of claim 10, wherein the summation is determined by a wagering game server coupled to the plurality of gaming machines, the wagering game server further providing game content to the plurality of gaming machines.

18. The method of claim 10, wherein the transferring occurs automatically from the first account to the second account.

19. A gaming system configured to monitor wagering game performance in a gaming establishment, the gaming system comprising:

a plurality of gaming machines, each gaming machine of the plurality being operable to conduct one or more wagering games in which a plurality of symbols indicate randomly selected outcomes of the one or more wagering games, each gaming machine further having a theoretical payback that is based on a math algorithm for generating the randomly selected outcomes and an actual payback that is based on the randomly generated outcomes generated by each gaming machine in response to wagers;

a communications interface connecting the plurality of gaming machines to a communications network;

one or more network processors; and at least one memory device storing instructions that, when executed by the one or more network processors, cause the gaming system to:

determine an individual differential comprising a difference between the theoretical payback and the actual payback of each gaming machine of the plurality; and transfer funds from a first account to a second account, said funds corresponding to a summation of the individual differentials over a certain period of time.

20. The system of claim 19, wherein the first account is associated with the gaming establishment, and the second account is associated with a gaming machine manufacturer.

21. A machine-readable, non-transitory medium including executable instructions that, when executed by a gaming system, cause the gaming system to perform a method comprising:

receiving, via at least one input device, wagers from players for playing one or more wagering games on at least one gaming machine at a gaming establishment, the at least one gaming machine having a theoretical payback based on a math algorithm for generating randomly selected outcomes in the one or more wagering games played over a certain amount of time;

providing, via one or more first processors, an actual payback to players of the one or more wagering games based on randomly selected outcomes of the one or more wagering games played over the certain period of time;

determining, via one or more second processors, a differential between the theoretical payback and the actual payback for the wagering games played over the certain period of time; and in response to the theoretical payback being less than the actual payback, transferring, via at least a first or second processor, funds corresponding to the differential from a first non-player account to a second account associated with the gaming establishment.

22. The medium of claim 21, wherein the method further includes, in response to the theoretical payback being greater than the actual payback, transferring the funds from the gaming establishment to the non-player account.

23. The medium of claim 21, wherein the medium resides on an accounting server connected to the at least one gaming machine via a communications network.

24. The medium of claim 21, wherein the one or more second processors reside within the at least one gaming machine, and wherein the method causes the one or more second processors to determine the differential of the respective at least one gaming machine.

25. The medium of claim 21, wherein the at least one gaming machine is a plurality of gaming machines, and wherein the differential comprises a summation of individual differentials of each of the plurality of gaming machines.

* * * * *

UNITED STATES PATENT AND TRADEMARK OFFICE

CERTIFICATE OF CORRECTION

PATENT NO. : 8,262,467 B2
APPLICATION NO. : 12/680828
DATED : September 11, 2012
INVENTOR(S) : Jaffe It is certified that error appears in the above-identified patent and that said Letters Patent is hereby corrected as shown below:

In the Claim

Column 14, line 52, claim 9, after "to" please insert -- a --.

Signed and Sealed this
Seventh Day of January, 2014

Margaret A. Focarino

Margaret A. Focarino
*Commissioner for Patents of the United States Patent and Trademark Office*